US011585182B1

(12) United States Patent
Egbe et al.

(10) Patent No.: US 11,585,182 B1
(45) Date of Patent: Feb. 21, 2023

(54) CASING HEAD SUPPORT UNIT (CHSU) DESIGN FOR LIFE CYCLE WELL INTEGRITY ASSURANCE

(71) Applicant: SAUDI ARABIAN OIL COMPANY, Dhahran (SA)

(72) Inventors: Peter Egbe, Dhahran (SA); Oladele Owoeye, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/455,447

(22) Filed: Nov. 18, 2021

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| RE21,952 | E | 11/1941 | Tschappat | |
| 2,346,060 | A * | 4/1944 | Yeatman | E21B 33/04 166/89.1 |
| 3,494,421 | A | 2/1970 | Dollison | |
| 4,501,441 | A | 2/1985 | Crews | |
| 4,691,780 | A | 9/1987 | Galle, Jr. et al. | |
| 4,911,244 | A | 3/1990 | Hynes | |
| 5,662,169 | A | 9/1997 | Hosie | |
| 6,202,745 | B1 | 3/2001 | Reimert et al. | |
| 7,779,921 | B2 * | 8/2010 | Cain | E21B 17/08 166/92.1 |
| 7,798,231 | B2 | 9/2010 | Ford | |
| 7,975,771 | B2 | 7/2011 | Ford | |
| 9,416,600 | B2 | 8/2016 | Golovinskij | |
| RE46,241 | E | 12/2016 | Cain et al. | |

FOREIGN PATENT DOCUMENTS

| | | | |
|---|---|---|---|
| FR | 2637316 | A1 * | 4/1990 |
| RU | 2146000 | C1 | 2/2000 |
| RU | 2269641 | C1 * | 2/2006 |
| RU | 152704 | U1 | 6/2015 |
| WO | 2009148320 | A1 | 12/2009 |

* cited by examiner

*Primary Examiner* — Matthew R Buck
(74) *Attorney, Agent, or Firm* — Osha Bergman Watanabe & Burton LLP

(57) ABSTRACT

A casing head support system (CHSS) for a casing head includes a casing head support unit (CHSU) having a tubular body with a support unit top end (SUTE) and a support unit bottom end (SUBE); a first conductor string extension joint coaxially fastened to the SUBE; and an internal load profile machined into an inner circumferential surface of the CHSU. The SUTE forms a coaxial connection with the casing head. The internal load profile supports a corresponding load shoulder on a conductor hanger. The CHSU contains a CHSU top preparation machined into the inner circumferential surface of the support unit. The CHSU top preparation is located at the SUTE. The CHSU top preparation mates with a corresponding casing head support unit running tool (CHRT) bottom preparation.

20 Claims, 7 Drawing Sheets

CASING HEAD SUPPORT UNIT (CHSU) DESIGN FOR LIFE CYCLE WELL INTEGRITY ASSURANCE

BACKGROUND

The disclosure relates generally to production of fluid from subterranean reservoirs.

Fluids are typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrocarbon reservoir may include natural gas, oil, and water.

Typically, a production tubing is disposed in the wellbore to carry the fluids to the surface. The wellhead system is sealed between the reservoir and the earth's surface for onshore wells, and between the reservoir, the seabed, and the sea surface for offshore wells. The wellhead system sits on a conductor casing as a means of structural support. The conductor is typically a pipe (called casing) of approximately 28" to 36" (inches) in outside diameter (depending on the application) that is laterally inserted into the earth's surface or seabed. A casing head support unit (CHSU) forms the interface between the top of the conductor and the bottom of the wellhead system.

Typically, the CHSU is welded to the top of the conductor. This welding operation takes place in the field at the location of the well. Often, the field location is not conducive to high-specification welding. Thus, the welding at the wellsite is performed without sufficient quality assurance, quality control, and quality surveillance to guarantee the integrity of the weld, and the weld may fail in use.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a casing head support system (CHSS) for a casing head, the CHSS comprising: a casing head support unit (CHSU) having a tubular body with a support unit top end (SUTE) and a support unit bottom end (SUBE), wherein the SUTE forms a coaxial connection with the casing head; a first conductor string extension joint coaxially fastened to the SUBE; and an internal load profile machined into an inner circumferential surface of the CHSU, wherein the internal load profile supports a corresponding load shoulder on a conductor hanger, wherein the CHSU contains a CHSU top preparation machined into the inner circumferential surface of the support unit, wherein the CHSU top preparation is located at the SUTE, and wherein the CHSU top preparation mates with a corresponding casing head support unit running tool (CHRT) bottom preparation.

In one aspect, embodiments disclosed herein relate to a casing head support system (CHSS) for a casing head having a first lateral end, the system comprising: a casing head support unit (CHSU) having a tubular body with a support unit top end (SUTE) and a support unit bottom end (SUBE), wherein the SUTE forms a casing head connection with the casing head; and a first conductor string fastened to the SUBE; wherein the CHSU contains a CHSU top preparation machined into the inner circumferential surface of the support unit, and wherein the CHSU top preparation is located at the top end and the top preparation mates with a corresponding casing head support unit running tool (CHRT) bottom preparation.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

Typically, down is toward or at the bottom and up is toward or at the top of the figure. "Up" and "down" are oriented relative to a local vertical direction. However, in the oil and gas industry, one or more activity takes place in a vertical, substantially vertical, deviated, substantially horizontal, or horizontal well. Therefore, one or more figure may represent an activity in deviated or horizontal wellbore configuration. "Uphole" may refer to objects, units, or processes that are positioned closer to the surface entry in a wellbore. "Downhole" may refer to objects, units, or processes that are positioned farther from the surface entry in a wellbore.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application.) The use of ordinal numbers is not to imply or create any particular ordering of the elements nor to limit any element to being only a single element unless expressly disclosed, such as using the terms "before", "after", "single", and other such terminology.

Rather, the use of ordinal numbers is to distinguish between the elements. By way of an example, a first element is distinct from a second element, and the first element may encompass more than one element and succeed (or precede) the second element in an ordering of elements.

Figure 1:
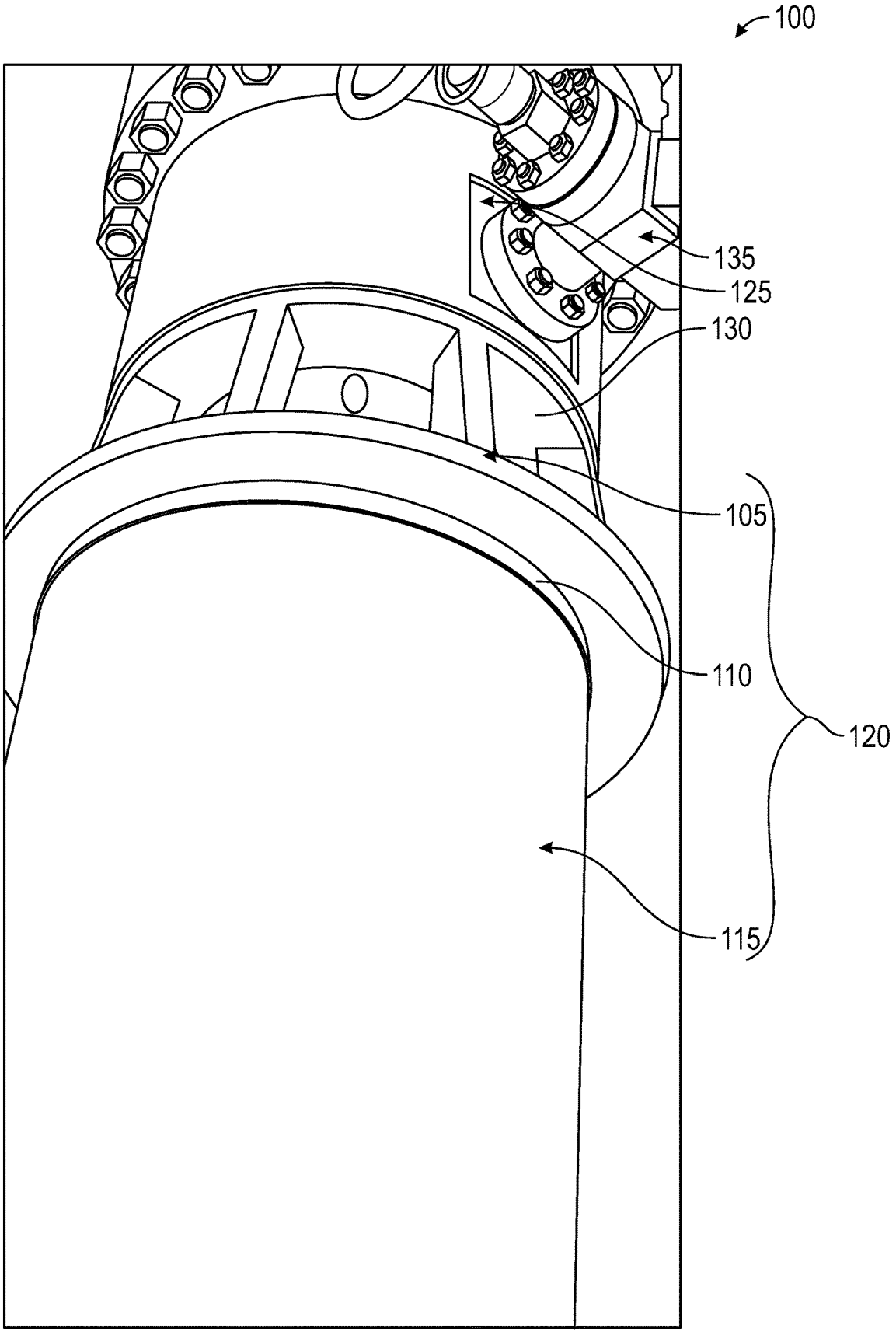
FIG. 1 is a schematic of typical installation with casing head housing landed on the casing head support unit (CHSU).

Disclosed herein is a design and technique for the installation of a Casing Head Support Unit (CHSU) in offshore and onshore oil and gas well operations. FIG. 1 shows a CHSU system (CHSS) (100) comprising a casing head support unit (CHSU) (105) with a support unit bottom end (SUBE) (110) coaxially welded to a first conductor string (115) to form a CHSU-conductor assembly (120) and with a casing head housing (125) coaxially connected to a support unit top end (SUTE) (130). The casing head housing (125) is shown with a side outlet valve (135).

Figure 2:
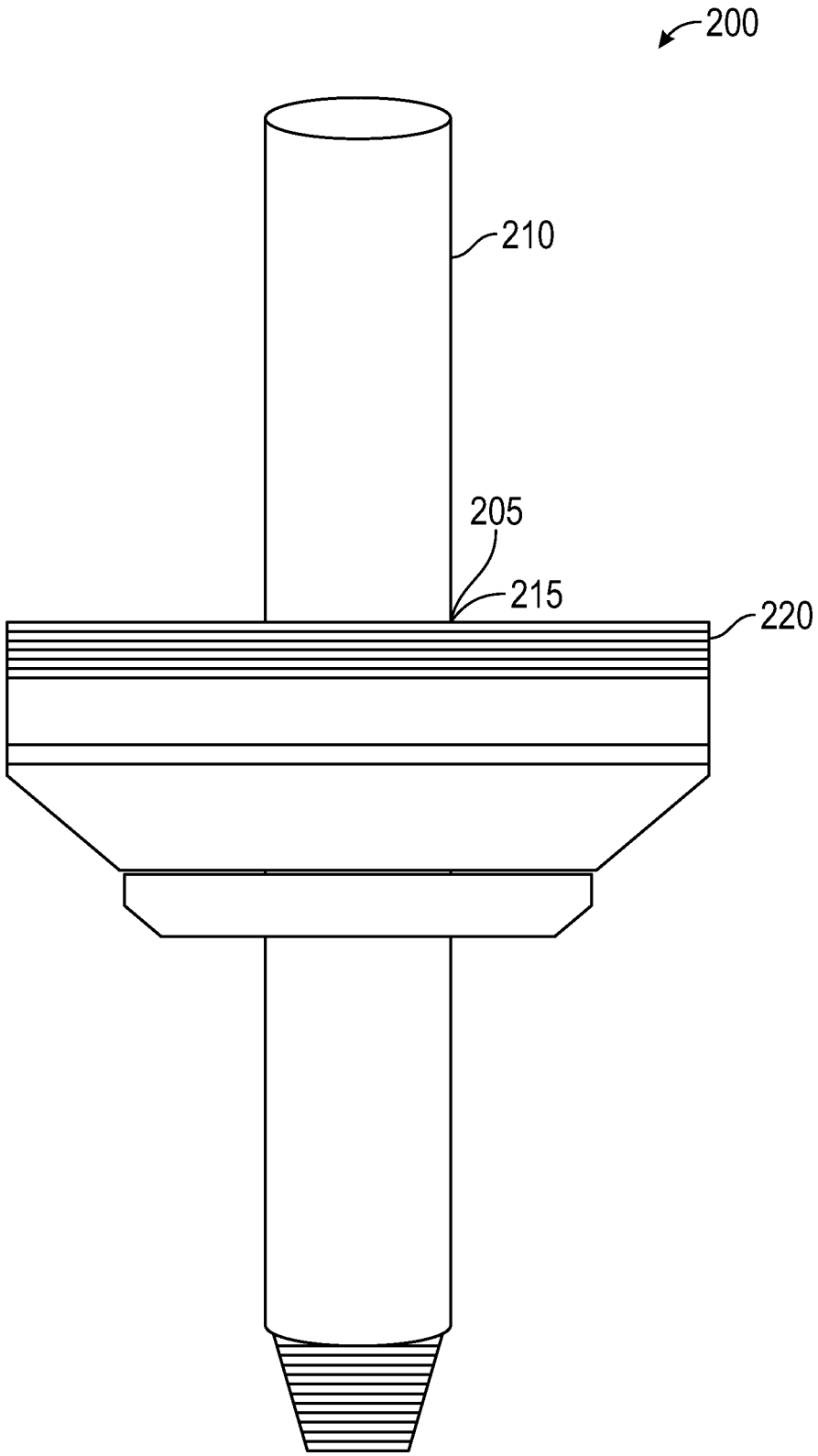
FIG. 2 is a schematic of a CHSU running tool.

FIG. 2 shows a casing head support unit running tool (CHRT) (200) with a box thread (205) on its top end, a representation of a drill string (210) with a pin thread (215) to engage the box thread (205), and a thread profile (220) to interface with the CHSU-conductor assembly (120) previously having been introduced. In one or more embodiments, the lower section of the CHRT may include a tail pipe, which can be made up to a jet sub to provide for jetting action, if desired.

In the current practice, the CHSU is welded to the first conductor string in the field after the first conductor string is cut. In accordance with one or more embodiments, the CHSU with an internal load profile is welded to an extension joint (EJ) offsite in a controlled environment such as a fabrication shop. This weld forms a CHSU-EJ assembly pre-made offsite.

In accordance with one or more embodiments, the CHSU without the internal load profile and a casing adapter sub (CAS) are welded to an extension joint (EJ) offsite in a controlled environment. This welding forms a CHSU-CAS-EJ assembly. The CHRT thread profile interfaces with the CHSU-EJ assembly and the CHSU-CAS-EJ assembly. In accordance with one or more embodiments, the extension joint is compatible for connecting with the first conductor string without a requirement for cross-overs. The extension joint bottom connection profile will be machined as per industry standard such as American Petroleum Institute (API) and will be compatible with the connection of the outermost conductor string (field conductor, the first conductor string already installed at the site) connection without a requirement for cross-overs. In accordance with one or more embodiments, the top preparation of the extension joint will be plain-ended to allow for welding of the extension joint to the bottom preparation of the CHSU.

In accordance with one or more embodiments, the CAS may have a similar OD (outer diameter) as the first conductor string. In accordance with one or more embodiments, the CAS or the CAS-EJ assembly may be ten to twenty feet long with similar or higher burst, collapse, and axial rating as the first conductor string.

One or more embodiments improve drilling efficiency and eliminate the need at the wellsite to cut the first conductor string and to weld the CHSU to the first conductor string. In one or more embodiments, two different types of CHSU with different techniques of installation may be employed depending on the type of application or whether another conductor string is required or not prior to deploying the surface casing with the casing head housing in an oil and gas well. In one or more embodiments, challenges associated with deployment of the CHSU are resolved and the majority of the post-installation failures of the CHSU can be avoided.

The post-installation failures of the CHSU typically result in well shut in and the associated loss of potential, and costly and extensive wellhead repair to restore production. The post-installation failures of the CHSU include damage to the weld between the first conductor string and the CHSU. Another post-installation failure of the CHSU includes a leak from or between casing-casing annulus #5 (CCA-5) and casing-casing annulus #4 (CCA-4). CCA-5 is formed by the annular space between the inside wall of the first conductor string and the outside wall of the second conductor string. CCA-4 is formed by the annular space between the inside wall of the second conductor string and the outside wall of the surface conductor.

Figure 3:
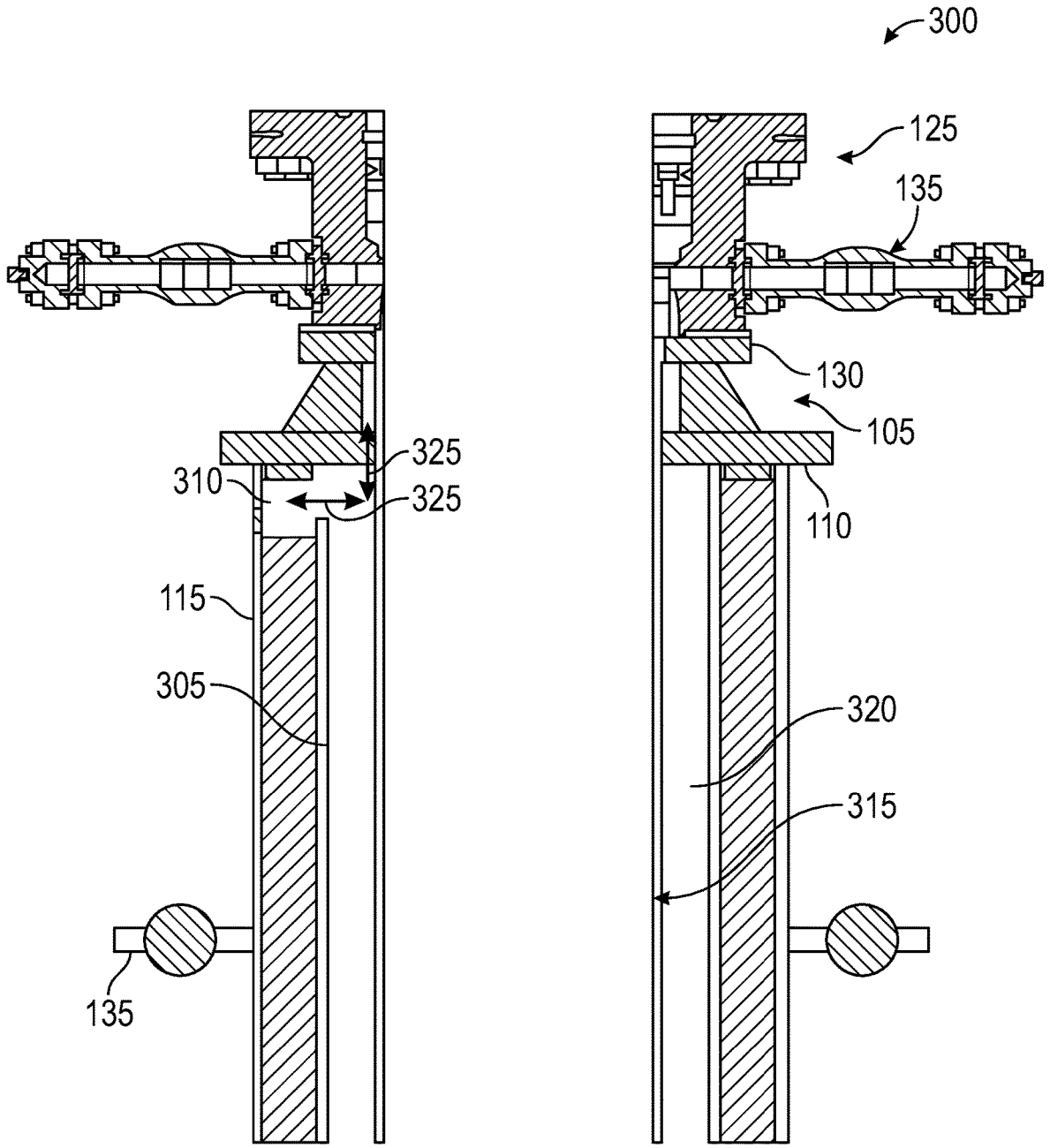
FIG. 3 shows current practice with CHSU in offshore operations with potential leak paths.

In one or more embodiments, a higher quality weld for the CHSU to the first conductor string can be provided as a proper quality assurance process will be in place in a controlled environment when welding the CHSU to the conductor extension joint. This is in contrast to the current practice in operations where the first conductor string, or both the first conductor string and the second conductor string are cut on the critical operation path at the wellsite, and the CHSU is welded to the cut first conductor string by the local rig welder. This practice often results in a damaged weld and leak paths in CCA-4 and CCA-5. This potentially leads to wells shut in followed by extensive wellhead repair work. FIG. 3 shows a current configuration and installation practice with the CHSU in most offshore operations.

FIG. 3 shows a current practice (300) of the casing head housing (125) coaxially connected to the SUTE (130). The SUBE (110) is fastened to the first conductor string (115). A second conductor string (305) is shown below the CHSU (105) and inside the first conductor string (115) forming a CCA-5 (310). The second conductor string (305) is not attached to the CHSU (105). A surface casing (315) is shown connected to the casing head housing (125) and inside the second conductor string (305) forming a CCA-4 (320). Using this practice, a leak path (325) may be formed between the CCA-5 (310), the CCA-4 (320), and the CHSU (105). The CHSU system may include a side outlet valve (135) or a plurality of side outlet valves (135) to allow for circulation or cement returns during cementation of the second conductor string or for pressure monitoring purposes.

Figure 4:
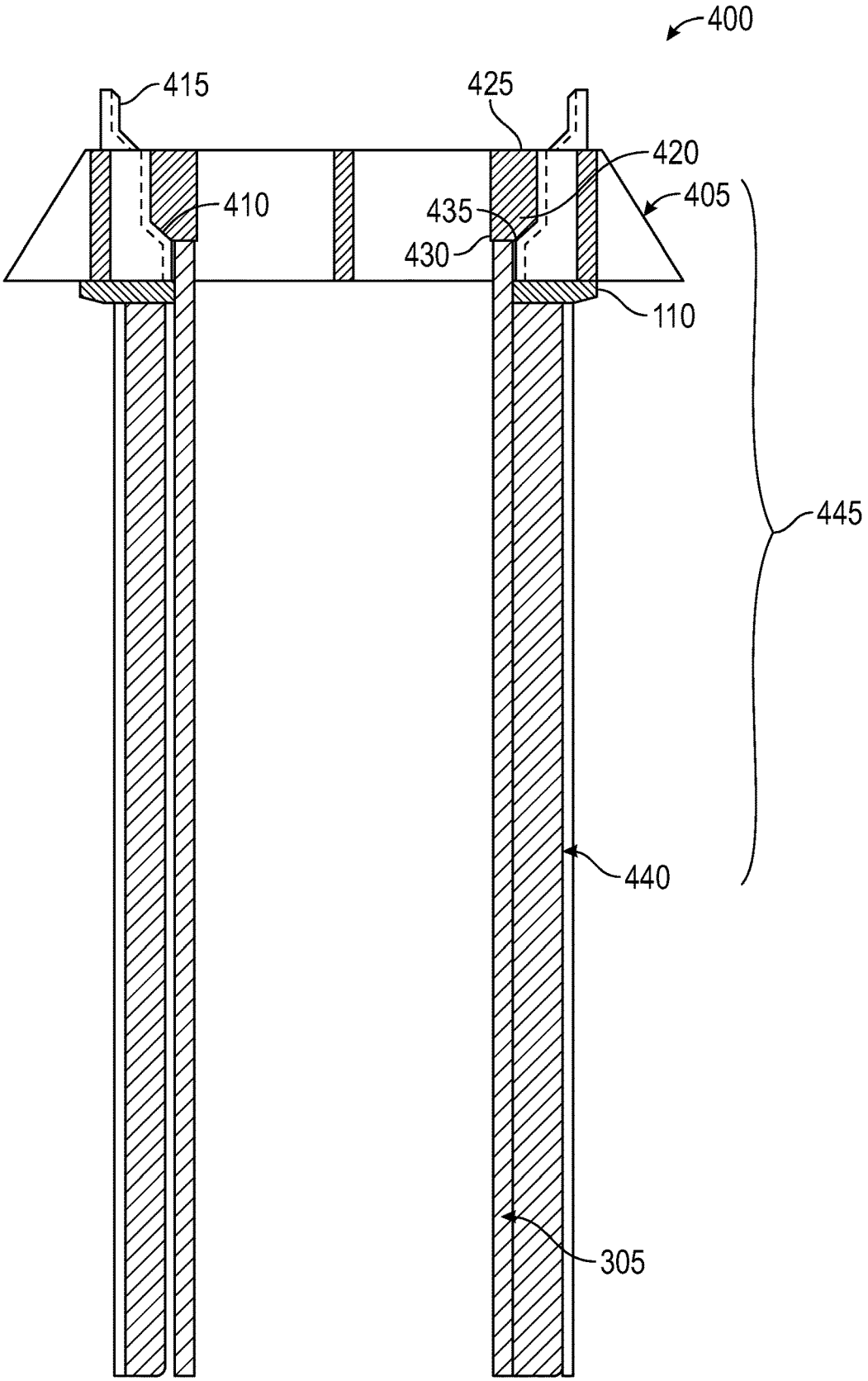
FIG. 4 is a CHSU with a conductor string landed.

In accordance with one or more embodiments, FIG. 4 shows a casing head support system (400) comprising a casing head support unit (CHSU) (405) with a CHSU internal load profile (410) and a top preparation (415). The first conductor string extension joint (440) is coaxially fastened to the SUBE (110) to form CHSU-EJ assembly (445). A conductor hanger (420) has a conductor hanger top end (425), a conductor hanger bottom end (CHBE) (430), and a conductor hanger load shoulder (435). The conductor hanger bottom end (430) is coaxially connected to the top of the second conductor string (305). The conductor hanger load shoulder (435) corresponds to the CHSU internal load profile (410). The CHSU internal load profile (410) supports the corresponding conductor hanger load shoulder (435). The CHRT previously having been introduced engages the top preparation (415).

One or more embodiments will effectively transfer compressive loads, like the blow out preventer weight or other landing loads, in the ratio of their relative rigidity to the outmost conductor string without damage to the weld area. One or more embodiments is expected to eliminate the frequent weld failures on most 36" (inch) conductors installed in offshore gas fields.

The internal profile of the new CHSU includes a 45° (degree) load shoulder with capability to land and hang the next conductor string. The 450 load shoulder improves the load distribution of the landed string to the first conductor string. The application of one or more embodiments is not limited to big bore wells where an additional conductor string is needed to isolate problem zones or to protect a fresh water aquifer or a shallow reservoir prior to setting the surface casing.

In one or more embodiments, the CHSU will be designed with sufficient height such that on landing the next conductor string, the casing head housing with a side outlet valve or valves can still sit on top of the CHSU as shown in FIG. 1.

One or more embodiments eliminate the current practice of having a cemented free-standing second conductor string as both first the conductor string and the second conductor string are cut and the CHSU is welded to only the first conductor string, thereby leaving the second conductor string without interaction with the first conductor string or rest of the system.

Figure 5:
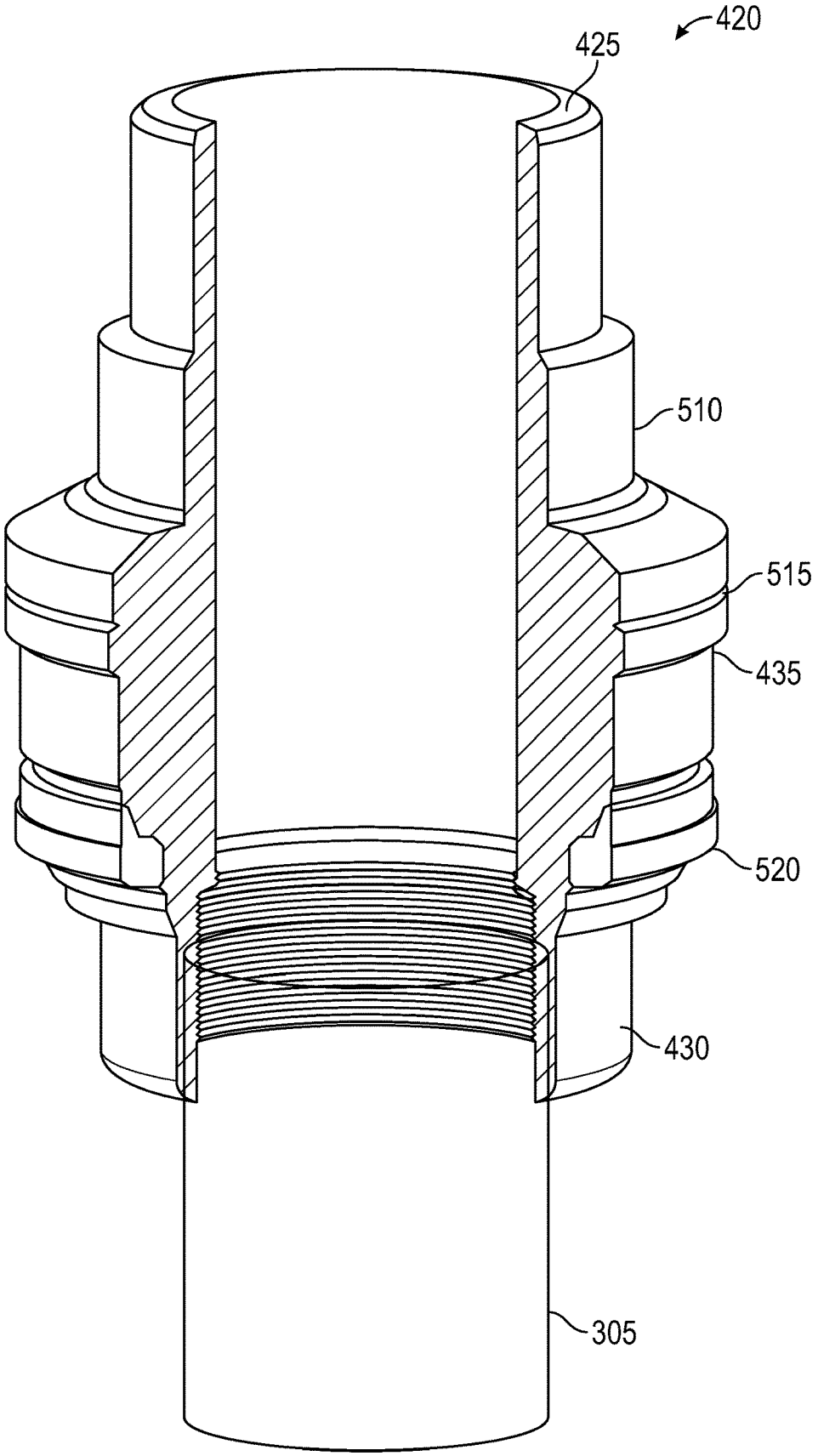
FIG. 5 is a schematic of the low-pressure hanger for the conductor string.

In accordance with one or more embodiments, FIG. 5 shows the conductor hanger (420). The second conductor string (305) attaches to the conductor hanger bottom end (430). The conductor hanger (420) comprises a conductor hanger load shoulder (435). A conductor hanger running tool engages a conductor hanger external thread (510). The conductor hanger optionally comprises a seal (515) and a latch (520). In accordance with one or more embodiments the seal may be a low-pressure seal. In accordance with one or more embodiments, the seal may include an inner annular seal and a seal energizing ring. In accordance with one or more embodiments, the CHSU may include a groove arranged to cooperate with the latch on the conductor hanger. In accordance with one or more embodiments, the CHSU may include a sealing area arranged to cooperate with the seal on the conductor hanger. In accordance with one or more embodiments, the CHSS may include a hanger latch activation tool. The seal (515) isolates CCA-5 previously having been introduced. The conductor hanger is arranged such that when installed in the CHSU or CAS, the second conductor string supported on the hanger assembly is able to move relative to the CHSU or CAS and the first conductor string during production and shut-in conditions.

Figure 6:
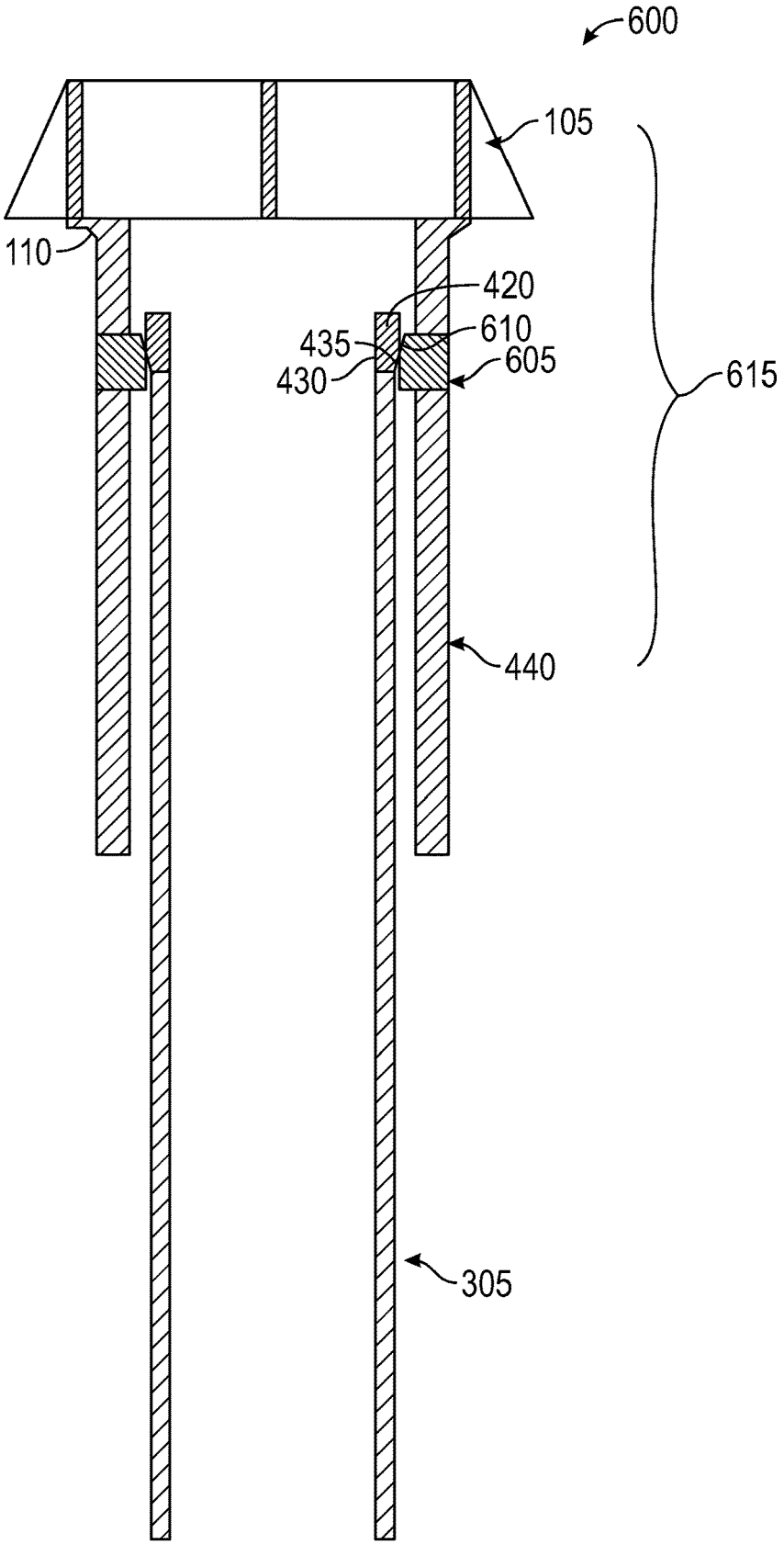
FIG. 6 is a schematic of second conductor string landed in outermost casing adapter sub.

In accordance with one or more embodiments, FIG. 6 shows a casing head support system (600) comprising the CHSU (105) coaxially fastened to the first conductor string extension joint (440). The casing adapter sub (CAS) (605) is coaxially fastened to the first conductor string extension joint (440) at a position below the SUBE (110) to form the CHSU-CAS-EJ assembly (615). The conductor hanger (420) is shown with the conductor hanger load shoulder (435) corresponding to a CAS internal load profile (610). The CAS internal load profile (610) supports the corresponding conductor hanger load shoulder (435). The conductor hanger (420) is shown with the second conductor string (305) attached to the conductor hanger bottom end (430). In accordance with one or more embodiments, the CAS (605) may include the groove arranged to cooperate with the latch on the conductor hanger. In accordance with one or more embodiments, the CAS may include the sealing area arranged to cooperate with the seal on the conductor hanger. In accordance with one or more embodiments, the casing head support system (600) may include the hanger latch activation tool.

In one or more embodiments, this alternative design utilizes a similar internal configuration as that of the standard CHSU with a flush internal profile (i.e., no load shoulder for landing the next conductor string), but with an extension joint as described previously. Where it is desired to install the second conductor string in the well, the first conductor string extension joint or the first conductor string itself (field conductor) may include a 24" to 36" alternative conductor hanger system depending on the size of the first conductor string and the second conductor string. For example, for a 36" first conductor string and a 30" second conductor string, the alternative conductor hanger system will be a 36"×30" alternative conductor hanger system. One or more embodiments include a 36"×30" adapter sub that includes an internal load profile that allows landing of the 30" conductor string and allows the conductor hanger to be set inside the 36" first conductor string.

One or more embodiments include a second conductor string hanger that lands out on the internal load profile of the 36"×30" adapter. The alternative conductor hanger includes a mechanism not limited to a split lock ring for locking and transferring the hanger loads and pressure to the 36" first conductor string. Where there is no requirement to run the second conductor string, the internal diameter of the CHSU will be slick (without the internal load profile) and then there is no requirement to include an alternative conductor adapter sub. The casing head housing with the surface casing will land and sit on top of the CHSU. In accordance with one or more embodiments, the CHSU system may include a side outlet valve or valves to allow for circulation or cement returns during cementation of the second conductor string or for pressure monitoring purposes.

One or more embodiments of the CHSU include a thread profile at the top of the CHSU to accept the CHSU running tool. One or more embodiments of the CHSU uses a running tool with an industry standard such as API 6-⅝" REG box up top connection profile or any connection specified by the client to match the drill pipe or landing string thread profile as well as an external thread profile to interface with the CHSU. Similarly, the first conductor string may utilize one or more embodiments of the CHSU system having an OD tubular range from 24" to 36".

Figure 7:
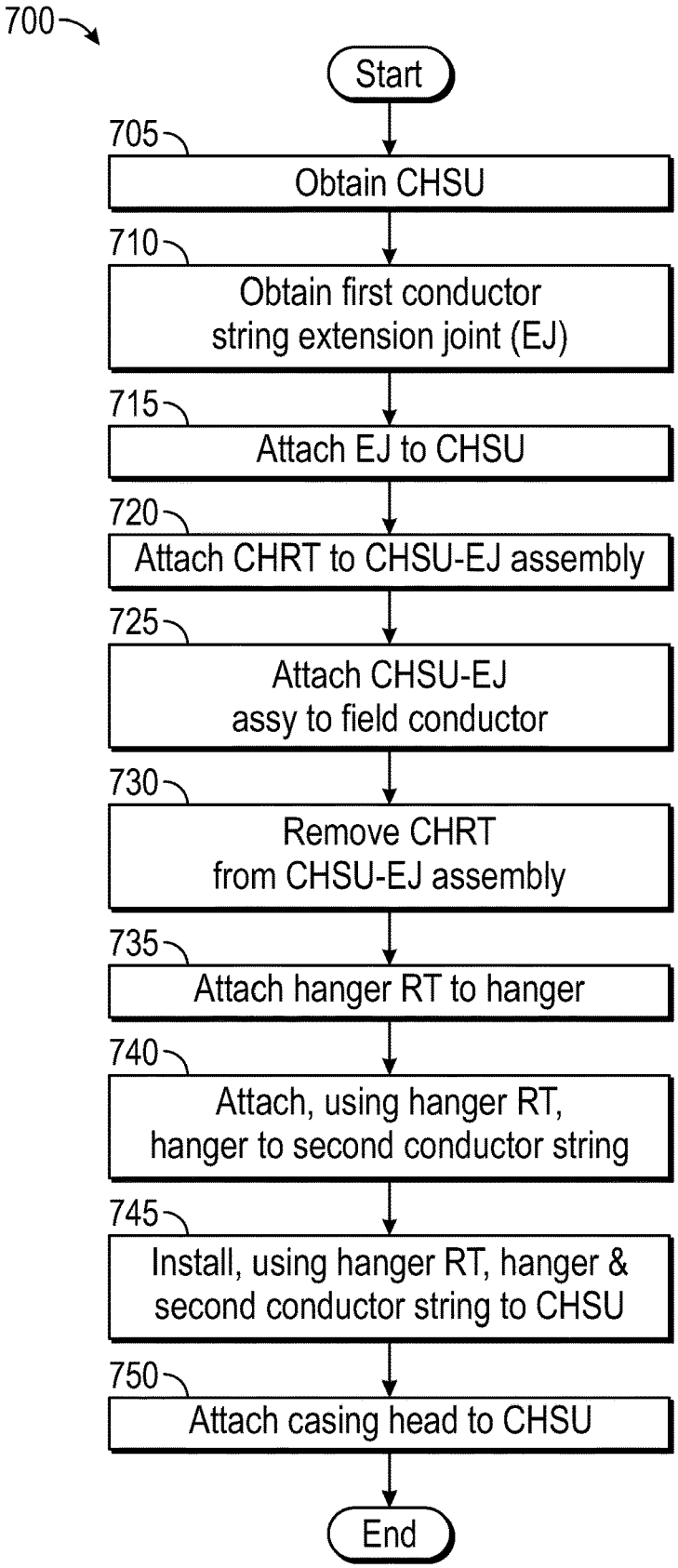
FIG. 7 is a flowchart in accordance with one or more embodiments.

FIG. 7 shows a flowchart in accordance with one or more embodiments. At the outset, the process (700) begins with obtaining the CHSU (step 705) and the first conductor string extension joint (EJ) (step 710). Next, the EJ is attached to the CHSU (step 715) to form the CHSU-EJ assembly. The CHRT is attached to the CHSU (step 720) and is used to attach the CHSU-EJ assembly to the field conductor (step 725), and afterward the CHRT is detached from the CHSU (step 730). Then, the conductor hanger running tool is attached to the conductor hanger (step 735) and attaches the conductor hanger to the second conductor string (step 740). The conductor hanger running tool installs the hanger and the second conductor string into the CHSU (step 745). The casing head housing is attached to the CHSU (step 750).

Embodiments of the present disclosure may provide one or more of the following advantages. In one or more embodiments, the system isolates CCA-5. In one or more embodiments, the system eliminates reoccurring failure with potential hydrocarbon leakage from CCA-5 in conditions when CCA-5 is exposed to hydrocarbon bearing zones. In one or more embodiments, the system eliminates the potential for CCA-5 and CCA-4 to be in communication, which sometimes complicates the identification of leak paths. In one or more embodiments, the system mitigates against the associated loss of well production potential and unplanned intervention costs required to return the well to a state of good repair. In one or more embodiments, in addition to providing a redesigned CHSU, a technique is provided to obtain the similar benefits while utilizing current CHSU designs.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A casing head support system (CHSS) for a casing head, the CHSS comprising:

a casing head support unit (CHSU) having a tubular body with a support unit top end (SUTE) and a support unit bottom end (SUBE), wherein the SUTE forms a coaxial connection with the casing head;

a first conductor string extension joint coaxially fastened to the SUBE; and an internal load profile machined into an inner circumferential surface of the CHSU, wherein the internal load profile supports a corresponding load shoulder on a conductor hanger, wherein the CHSU contains a CHSU top preparation machined into the inner circumferential surface of the support unit, wherein the CHSU top preparation is located at the SUTE, wherein the CHSU top preparation mates with a corresponding casing head support unit running tool (CHRT) bottom preparation, wherein the system further comprises a casing head support unit running tool (CHRT) having the corresponding CHRT bottom preparation that mates with the CHSU top preparation, and wherein the CHRT bottom preparation is an external thread.

2. The system of claim 1, wherein the internal load profile is angled at a forty-five-degree angle.

3. The system of claim 1, wherein the CHSU top preparation is an internal thread, wherein the internal thread mates with the external thread on the CHRT.

4. The system of claim 1, wherein the system further comprises the conductor hanger having the load shoulder corresponding to the internal load profile of the CHSU.

5. The system of claim 4, wherein the conductor hanger has a conductor hanger top end (CHTE) and a conductor hanger bottom end (CHBE), wherein the conductor hanger has a conductor hanger preparation at the CHTE, wherein the conductor hanger preparation engages a conductor hanger running tool, wherein the conductor hanger preparation comprises a first thread and the first thread mates with a corresponding second thread on the conductor hanger running tool, and wherein the conductor hanger comprises a box profile at the CHBE.

6. The system of claim 4, wherein the conductor hanger has a low-pressure seal.

7. The system of claim 6, wherein the low-pressure seal is made of at least one of or a combination of elastomeric material, seal backup ring, and metallic material.

8. The system of claim 4, wherein the conductor hanger has a locking mechanism to axially affix the conductor hanger to the CHSU.

9. The system of claim 8, wherein the locking mechanism is a split lock ring.

10. The system of claim 1, wherein the first conductor string extension joint has at least one side outlet valve.

11. A casing head support system (CHSS) for a casing head having a first lateral end, the system comprising:

a casing head support unit (CHSU) having a tubular body with a support unit top end (SUTE) and a support unit bottom end (SUBE), wherein the SUTE forms a casing head connection with the casing head; and a first conductor string fastened to the SUBE;

wherein the CHSU contains a CHSU top preparation machined into an inner circumferential surface of the support unit, wherein the CHSU top preparation is located at the top end and the top preparation mates with a corresponding casing head support unit running tool (CHRT) bottom preparation, wherein the system further comprises a casing head support unit running tool (CHRT), wherein the CHRT contains the CHSU bottom preparation that mates with the CHSU, and wherein the CHRT bottom end preparation is an external thread.

12. The system of claim 11, wherein an internal load profile is machined into an inner circumferential surface of a casing adapter sub (CAS), wherein the internal load profile supports a corresponding load shoulder on a conductor hanger, and wherein the internal load profile is a forty-five-degree angle; and wherein the CAS is coaxially fastened to the first conductor string.

13. The system of claim 11, wherein the CHSU top preparation comprises a first thread and the first thread mates with a corresponding thread on the CHRT.

14. The system of claim 11, wherein the system further comprises a conductor hanger with a conductor hanger top end (CHTE) and a conductor hanger bottom end (CHBE); and wherein the conductor hanger comprises a load shoulder corresponding to an internal load profile of a CAS.

15. The system of claim 14, wherein the conductor hanger has a preparation at the CHTE, wherein the preparation engages a conductor hanger running tool, wherein the conductor hanger top preparation comprises a first thread and the first thread mates with a corresponding thread on the conductor hanger running tool, and wherein the conductor hanger comprises a box profile at the CHBE.

16. The system of claim 14, wherein the conductor hanger has a low-pressure seal.

17. The system of claim 16, wherein the low-pressure seal is made of at least one of or a combination of elastomeric material, seal backup ring, and metallic material.

18. The system of claim 14, wherein the conductor hanger has a locking mechanism to axially affix the conductor hanger to the CHSU.

19. The system of claim 18, wherein the locking mechanism is a split lock ring.

20. The system of claim 11, wherein the first conductor string has at least one side outlet valve.

* * * * *